United States Patent [19]

Finkbeiner

[11] 4,405,913

[45] Sep. 20, 1983

[54] COIL BODY

[75] Inventor: Ernest Finkbeiner, Grayslake, Ill.

[73] Assignee: Mid-West Transformer Company, Grayslake, Ill.

[21] Appl. No.: 293,199

[22] Filed: Aug. 17, 1981

[51] Int. Cl.[3] ..... H01F 27/02; H01F 27/30

[52] U.S. Cl. ..... 336/98; 336/198

[58] Field of Search ..... 336/198, 196, 208, 90, 336/98

[56] References Cited

U.S. PATENT DOCUMENTS 3,839,690 10/1974 Kobler et al. ..... 336/198 X 3,909,761 9/1975 Miles ..... 336/208 X

FOREIGN PATENT DOCUMENTS 2310974 9/1973 Fed. Rep. of Germany ..... 336/198

2326126 1/1974 Fed. Rep. of Germany ..... 336/198

*Primary Examiner*—Thomas J. Kozma

*Attorney, Agent, or Firm*—Hill, Van Santen, Steadman & Simpson

[57] ABSTRACT

A transformer coil body providing an elongated creepage path between primary and secondary windings has at least one U-shaped channel member with a portion thereof projecting between the primary and secondary windings providing a surpentine creepage path, the minimum distance of which is at least as great as established creepage distance standards, the coil body being formed of a single piece.

3 Claims, 15 Drawing Figures

FIG. 1
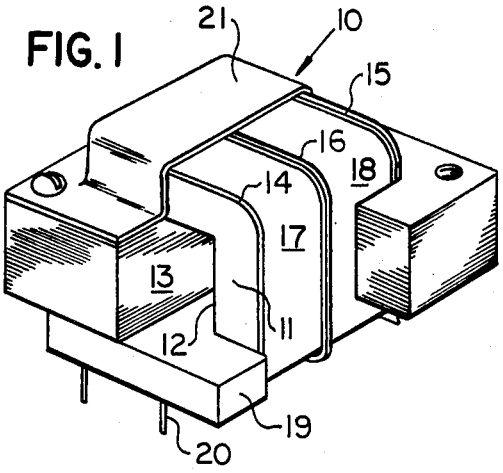
FIG. 2
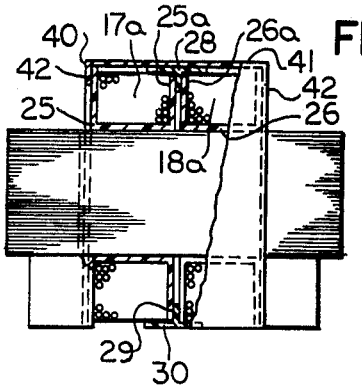
FIG. 3
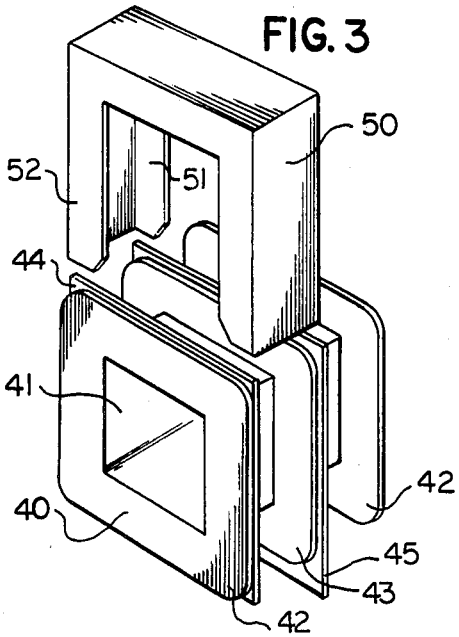
FIG. 4
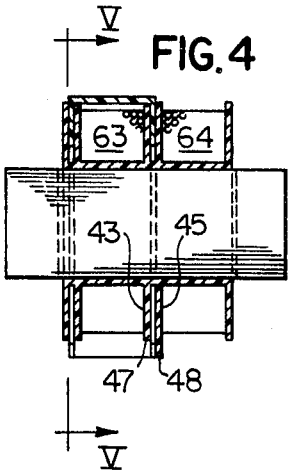
FIG. 6
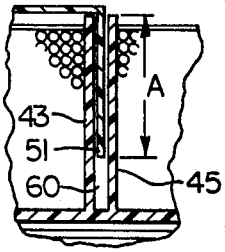
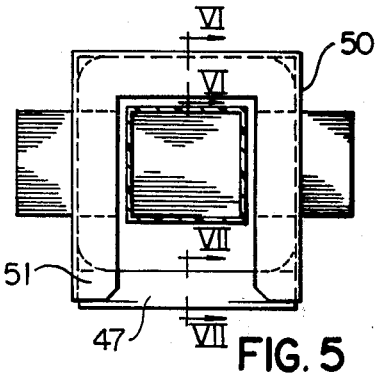
FIG. 5
FIG. 7
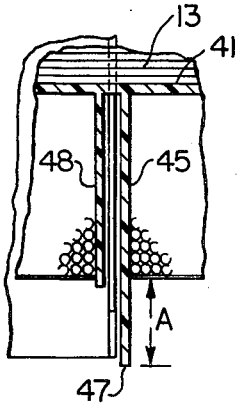
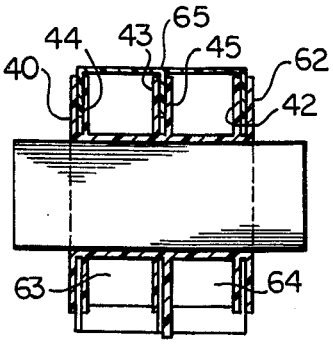
FIG. 8
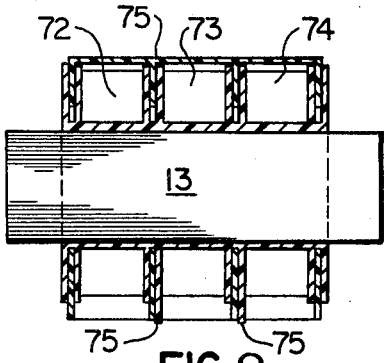
FIG. 9

FIG 10
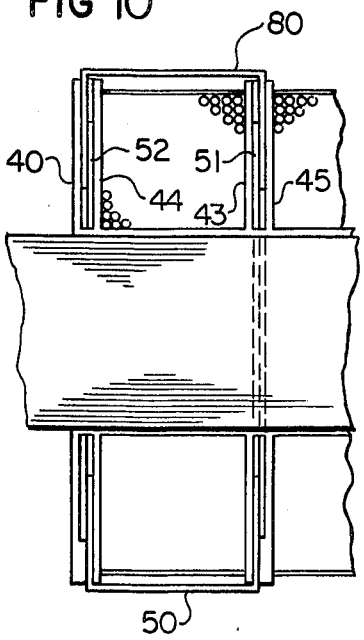
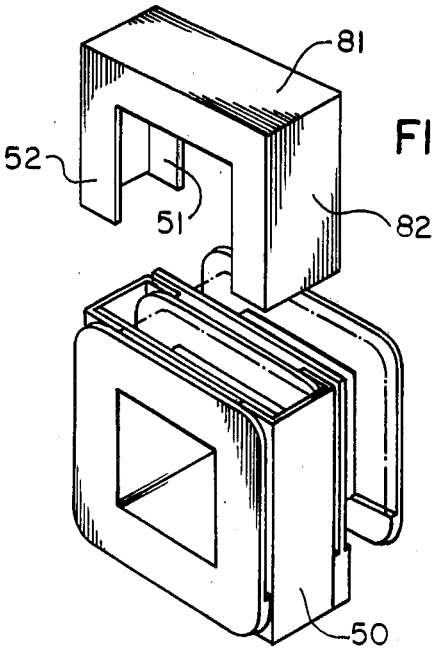
FIG 11
FIG 12
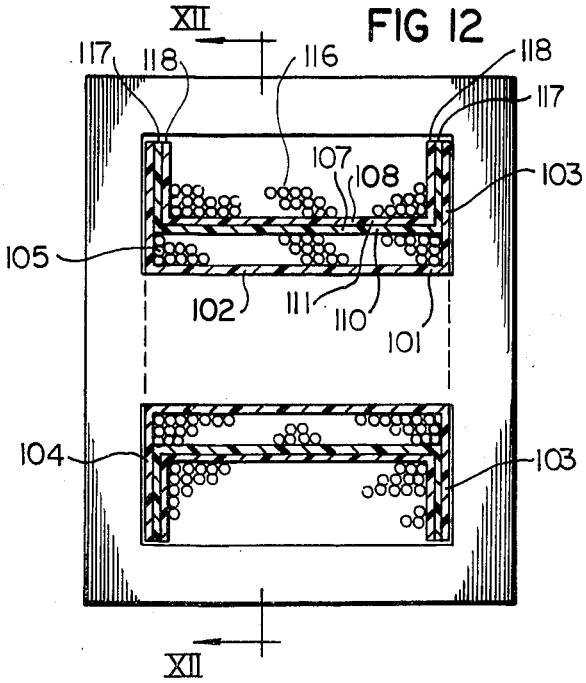
FIG 13
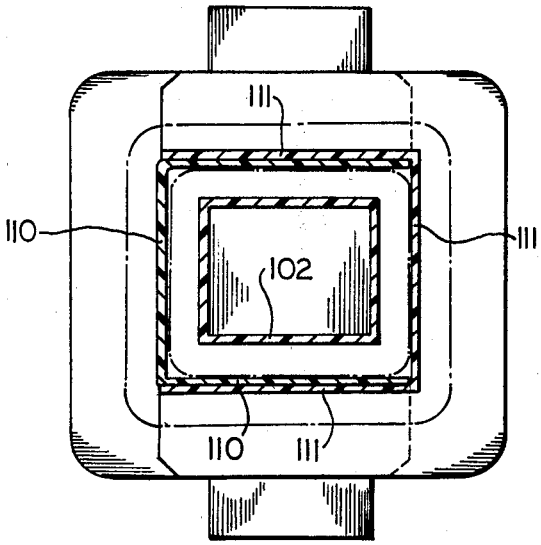
FIG 15
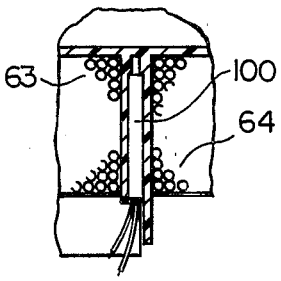
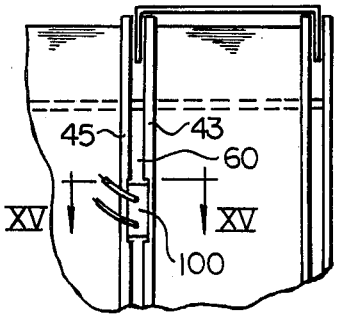
FIG. 14

COIL BODY

BACKGROUND OF THE INVENTION

1. Field of the Invention

This invention relates to transformer coil bodies and more particularly to a molded transformer coil body or bobbin.

2. Description of the Prior Art

In the United States transformer coil bodies are normally formed of plastics materials. Two primary types are used, those having axially separated winding areas and those having radially separated winding areas. Such coil bodies may have primary and secondary winding areas, two primary and a single secondary, or two secondary and a single primary. In standard U.S. bodies the primary area and secondary areas are normally separated by a single wall member. A common design is to provide a core tube, normally rectangular in cross-section and a plurality of outwardly projecting flange walls axially spaced along the length of the core tube to define winding areas between the walls radially of the core tube. Such coil bodies are formed, as desired, with other projecting members such as mounting members, pin members, etc. Commonly, the entire coil body is formed of a single molded plastic piece. Existing winding machines are designed to accommodate such single piece coil bodies.

On the other hand, standards of other countries, such as the countries of the European common market, have adopted standards providing for a minimum creepage distance between the primary and secondary windings. Although such minimum creepage distances can be established by making the projecting walls between the winding areas of a height from the outermost coil winding equal to at least half the minimum creepage distance whereby the entire minimum creepage distance will be established as the creepage path up one side of the wall from the winding of the one coil thence down the other side of the wall to the winding of the other coil, such a solution is undesired. An extended wall solution would require a greater than desired height for the overall transformer which height would be made up mostly of wasted space, i.e. the space outward from the outermost winding. Since the metal laminates of the transformer are commonly E-shaped having a central tang in the core tube and legs extending axially of the coil body immediately outwardly of the walls, such a solution would provide a greater spacing between the legs and tang than is otherwise desired.

It has been known to solve the problem of the minimum creepage path by providing a separate T-shaped cross-section member between individual bodied portions with one body portion used for the primary winding coil and a second body portion used for the secondary winding coil. The leg of the T is positioned between the two body portions with the cross bar of the T overlying each of the body portions. Both the leg and the cross bar are then dimensioned to be of a length such that the creepage path around the leg or around the cross bar from the outermost coil winding is equal to the minimum creepage distance established by various standards.

While such solutions have overcome the height problem, they complicate manufacture and assembly of the transformer since individual winding areas must be provided as separate parts. This is required because once the cross bar extends over the winding area, the coil could not be wound. Therefore, the coils must be wound around the individual body parts prior to assembly with the T-shaped cross-section member.

It would therefore be an advance in the art to provide a transformer coil having an elongated creepage path between primary and secondary windings without increasing the height of the coil body around the entire periphery thereof and without requiring separate coil bodies for the primary and secondary windings.

SUMMARY OF THE INVENTION

The above problems associated with the prior art are overcome by the present invention which has as its principal object the formation of a one piece transformer coil body having winding areas for primary and secondary windings with an elongated creepage path provided between the primary and secondary windings provided by insert members inserted between the primary and secondary winding areas, the insert members providing a surpentine path along the dielectric surfaces between the primary and secondary windings, the path creating insertions being easily applied to the coil body without significantly increasing the height of the coil body around more than a portion of the periphery of the coil body.

This object is achieved by providing a coil body having a central hollow core defined by a core tube, a core tube being provided with a plurality of axially spaced, outwardly projecting walls, the walls defining therebetween, and around the core tube, winding areas. An additional wall is provided closely spaced from a wall separating two winding areas to provide a space between the additional wall and the separating wall. The additional wall has a height substantially coextensive with the separating wall for at least a portion of the periphery of the body. In this manner, the height of the body for that portion of the periphery is not increased by the addition of the additional wall.

In one form usable in axially spaced winding coils a cap member having a leg is attached to the body after winding of the coil. The leg extends down between the additional wall and the separating wall a distance equal to at least half the minimum creepage path distance. Projecting from the leg is a cap portion overlying the coil. Again the cap portion has a projected distance determined according to the minimum creepage path. The cap member does not extend around the entire periphery of the body, but does extend around that portion of the periphery where the additional wall is coextensive in height with the separating wall.

For the remaining portion of the periphery, the additional wall has a height greater than the separating wall, the additional height being determined such that the creepage path along that wall from the outermost coil winding to the periphery wall, than back along the other side of the wall, is at least the minimum creepage path distance.

In a preferred embodiment illustrated, the body is substantially rectangular with a substantially rectangular core tube. In this preferred embodiment the portion of the additional wall which is coextensive in height is formed on three contiguous sides of the coil body with the projecting or additional height portion formed on the fourth side. In such a structure, the cap will be U-shaped so as to be insertable into the slot space from the side opposite the extra height portion of the additional wall, there being three leg portions, one on each side normal to the side of the coil body having the additional projecting height wall and the third leg being on the side opposite the side of the coil body having the additional projecting wall such that on the three sides of the coil body not having the additional height of the additional wall, the legs are inserted into the space between the additional wall and the separating wall. On the fourth side the creepage path distance is determined by the height of the additional wall at that side. The legs provide a surpentine path for the creepage distance measurement.

In the preferred embodiment, a second additional wall is provided adjacent to one of the projecting walls spaced from the separating wall. The second additional wall may be formed coextensive in height with its adjacent wall around the entire periphery of the coil body. In this construction the cap is formed with two parallel sets of inturned legs, each being receivable in the space between a coil body wall and an additional wall with the portion overlying the winding extending then across the full winding area joining the legs. In such an embodiment, the coil area of at least one of the windings is then enclosed entirely on three sides by a channel cap.

Other modifications of the design are possible including double channel caps usable in connection with two winding area coil bodies where each of the walls of the coil body is formed as a double wall having a space between the double walls capable of receiving the three legs of the channel cap so as to enclose on three sides both of the winding areas. A further modification of this device can provide four legs for the channel cap and four sets of double walls to define three winding areas, particularly for transformer coils having a single primary and dual secondaries, or dual primaries and a single secondary.

In a further modification, the additional wall may have a height coextensive with the remaining walls around the entire periphery and a separate U-shaped cross-section cap member can be inserted from the side opposite the bight of the primary U-shaped cross-section cap member thereby enclosing the winding area on all four sides. Another embodiment of this invention is utilizible in those coil windings where the primary and secondary winding areas are radially separated rather than axially separated. In this latter embodiment, the U-shaped channel cap is formed with a radially outwardly opening channel bounded by radially outwardly projecting side legs. In a rectangular transformer coil body, two such coil shaped members are inserted in bight opposed relationship telescoping into one another radially outwardly of the first winding area. The second winding area is then formed in the channel of the cap members. The legs of the cap members project outwardly a sufficient distance such that the distance from the outermost winding of the inner coil winding out along the leg, then back along the inside of the leg to the outermost winding of the outer coil winding a distance at least as great as the minimum creepage distance.

In a further modification of this invention a heat sensitive fuse is inserted between the separating wall and additional wall, preferably along that portion of the additional wall which has a greater height than the separating wall. In this manner, the heat sensitive fuse is located between the coil windings in a position to more accurately monitor overheating of the transformer than in prior devices.

It is therefore an object of this invention to provide an improved transformer.

It is another, and more specific object of this invention to provide an improved transformer having a minimum creepage path between primary and secondary windings defined along the shortest dielectric surface from the outermost winding of the primary to the closest winding of the secondary with the creepage path being elongated by a member interposed between the primary and secondary windings having a projecting wall such that the creepage path must traverse the wall distance, the coil body being made as a single piece and wound on conventional machinery.

It is yet another specific object of this invention to provide a transformer coil body having a single plastic body with primary and secondary winding areas with an elongated creepage path between the winding areas provided along the surface of an insert inserted between the primary and secondary windings, the insert having a projecting leg defining at least part of the creepage path.

It is another specific object of this invention to provide an improved transformer body having an elongated creepage path between primary and secondary axially spaced windings, the creepage path defined, in part, by an insert received between parallel separating walls between the primary and secondary windings, the insert having a leg inserted into the space between the parallel walls, and a second portion overlying one of the windings.

It is yet another specific object of this invention to provide an improved transformer having a coil body including a central hollow core defined by an axially extending core tube and a plurality of outwardly projecting walls extending from the tube axially spaced from one another around the periphery of the tube to define primary and secondary winding areas therebetween, the one of the walls forming a separating wall between the primary and secondary windings with at least one additional wall projecting outwardly around the entire periphery of the tube axially closely spaced from and substantially parallel to the separating wall, the additional wall having a height from the tube coextensive with the separating wall for at least a portion of the periphery of the body and a height greater than the separating wall for an additional portion of the periphery.

It is yet another, and more specific object of this invention to provide an improved transformer having a coil body including a central hollow core defined by an axially extending core tube and a plurality of outwardly projecting walls extending from the tube axially spaced from one another around the periphery of the tube to define primary and secondary winding areas therebetween, the one of the walls forming a separating wall between the primary and secondary windings with at least one additional wall projecting outwardly around the entire periphery of the tube axially closely spaced from and substantially parallel to the separating wall, the additional wall having a height from the tube coextensive with the separating wall for at least a portion of the periphery of the body and a height greater than the separating wall for an additional portion of the periphery with a cap having an inturned leg received in the space between the additional and the separating wall for at least the portion of the periphery, the cap having a portion extending over one of the secondary and primary winding areas for said portion of the periphery.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a perspective view, with portions broken away, of a prior art standard transformer.

FIG. 2 is a side plan view of a prior art transformer with portions broken away to show underlying portions.

FIG. 3 is a perspective exploded view of a transformer coil body according to this invention.

FIG. 4 is a sectional view of a transformer according to this invention.

FIG. 5 is a partially sectional plan view taken along the lines v—v of FIG. 4.

FIG. 6 is a fragmentary enlarged sectional view of the primary-secondary winding area separating wall generally in the area indicated by the line VI—VI of FIG. 5.

FIG. 7 is a view similar to FIG. 6 generally indicating the secondary primary separating wall in the area VII—VII of FIG. 5.

FIG. 8 is a bottom plan view of a transformer according to this invention showing a modification of the transformer of FIGS. 3 through 7.

FIG. 9 is a view similar to FIG. 8 showing a further modification.

FIG. 10 is an enlarged fragmentary view of another modification of the transformer coil of this invention.

FIG. 11 is a view similar to FIG. 3 showing a further modification of the transformer coil body of this invention.

FIG. 12 is a sectional plan view of yet another modification of this invention showing a radially wrapped transformer.

FIG. 13 is a sectional view taken along the lines XIII—XIII of FIG. 12.

FIG. 14 is an enlarged fragmentary plan view of a transformer according to one of FIGS. 3 through 9 showing placement of a heat fuse.

FIG. 15 is a fragmentary enlarged sectional view taken along the lines XV—XV of FIG. 14.

DESCRIPTION OF THE PREFERRED EMBODIMENTS

FIG. 1 illustrates a typical transformer 10 formed around a plastic molded coil body 11 having a core tube axial opening 12 therethrough. As is typical with many transformers, the axial opening 12 is formed as a rectangle, however, other configurations are well-known to the art and the tube wall defining the opening 12 may be square, rectangular, circular or other shaped as desired. The core 13 is received through the core tube. As is well-known, the core is made of a laminate stack of metal plates, generally E-shaped having a central tang extending through the core tube and outboard legs on either side of the coil with alternate E-shaped metal members being inserted from opposed ends of the core tube.

The coil body has a plurality of outwardly projecting walls 14, 15 and 16 with end walls 14 and 15 and a central wall 16 being illustrated in FIG. 1. Coil winding areas 17 and 18 are defined respectively between the walls 14 and 16 and 15 and 16, and coils are wound in the winding areas 17 and 18. In this manner, the central wall 16 forms a separator wall separating the coil winding areas.

As is well-known to the art, one of the coils will be a primary coil and the other a secondary coil with the number of windings in each winding area being determined by the desired step-up or step-down capability of the transformer. It is to be understood of course that the winding areas 17 and 18 may be of different axial dimensions as desired.

The coil body may be formed with extending base projections 19 having plug in tangs 20 or the like depending therefrom and the transformer may be provided with a top cover 21 as is well-known to the art.

In countries other than the United States, standards have been established for a minimum creepage path distance. The creepage path is defined as the shortest unblocked distance between the primary coil and the secondary coil. In a configuration such as in FIG. 1, the path distance then would be from the outermost coil of the winding area 17 around the outer periphery of the separator wall 16 to the outermost winding of the coil 18.

This distance will increase as the height of the wall 16 above the outermost winding increases. However, for various reasons, including a desire to keep the outboard legs of the laminates close to the coil windings, and to take up a minimum space by the transformer, it is not generally desired to increase the wall 16 beyond that made necessary by the stack height of the winding.

FIG. 2 illustrates a typical European transformer designed to provide the desired minimum creepage path distance. In this instance, each of the winding areas 17*a* and 18*a* are provided interior of U-shaped cross-sectioned individual separate coil bodies 25 and 26. The opposed legs 25*a* and 26*a* of the coil bodies 25 and 26 are spaced apart by a T-shaped flange member 28. The T-shaped flange member has a central upright 29 received between the bodies 25 and 26 and a cross bar 30 which overlies each of the coil areas by a predetermined amount. In this manner, the minimum creepage path would be either upwardly along the side of the upright 29, then outwardly along the underside of the cross bar, then back across the top of the cross bar, thence back on the underside of the cross bar on the other side of the upright, then downwardly to the coil in the other coil body, or, alternatively, surpentine, i.e. upwardly along the wall 25*a* to the cross bar, then downwardly between the wall 25*a* and the upright 29, thence upwardly between the upright 29 and the wall 26*a*, thence downwardly along the wall 26*a* to the winding in the area 18*a*.

A $\frac{3}{4}$ cap member 40 may then be used to lock the three pieces together into a single assembly, the cap member having an outer periphery 41 which extends around three sides of the coil bodies and member 28 and having inturned legs 42 at either end which overlie the outboard sides of the coil bodies 25 and 26.

The inability to make the coil body or bobbin out of a single piece due to the fact that the cross bar overlay would block access to the winding equipment to wind the coil radially inwardly of the cross bar precludes the use of standard bobbin winding equipment. Moreover, the use of individual coil bodies is expensive and requires time consuming assembly. Importantly, the prior art solution does not allow the use of standard configuration U.S. coil bodies.

As best shown in FIG. 3, my solution to this problem utilizes a coil body or bobbin 40 having a core tube 41 for receipt of the core, end walls 42 and an intermediate separator wall 43. Additional walls 44 and 45 are provided closely spaced to and parallel to the walls 42 and 43. There is thus provided a channel or space around the core tube 41 between the walls 42 and 44 and between the walls 43 and 45. Although walls 44 and 45 have been shown to be rectangular where walls 42 and 43 are rounded at the corners, it is to be understood that all walls could be rectangular or all walls could be rounded as desired providing minimum spacings are maintained.

The wall 45 is substantially equidistant in height from the core tube 41 with the wall 43 on three of the sides of the coil body. On the fourth side, illustrated at the bottom in FIGS. 3 and 4, the wall 45 has a projection 47 extending beyond the periphery 48 of separating wall 43. A cap member 50 is provided having an inturned leg 51 for receipt between the separating wall 43 and the additional wall 45. The cap member leg 51 is three sided being substantially U-shaped so that the leg 51 is inserted in the gap space between the wall 43 and the wall 45 around three sides of the coil body. This allows easy insertion of the cap member 50 after the coil has been wound. With the cap member inserted with the wall 51 between the walls 43 and 45, a creepage path is provided which is surpentine, i.e. upwardly along the inside face of the wall 43, around the periphery 48, thence downwardly between the leg 51 and the outside of the wall 43 to the bottom of the leg 51, thence back upwardly between the leg 51 and the opposed face of the additional wall 47, thence over the top of the wall 47 and downwardly to the outermost coil winding in the adjacent winding area. By dimensioning the depth of the leg 51, it can be assured that minimum creepage distances are easily maintained.

In order to prevent the creepage distance from being measured around the outside of the cap 51 which overlies the winding area, that leg is most expeditiously extended across the full width of the winding area terminating in a second inturned leg 52 received in the space between the wall 42 and the wall 44. This also serves to enclose the entire coil winding area between the wall 44 and the wall 43 on three sides of the coil winding area.

In order to provide the minimum creepage path on the fourth side, the extension 47 of the wall 45 extends outwardly beyond the outermost coil winding a sufficient distance so that the reverse path around the extension 47 is equal to the minimum creepage distance. This is necessary because the creepage path at that side of the coil would now be measured outwardly along the wall 43 thence along the leg 51 to the contacting side of the wall 45, thence around the wall 45 to the other coil.

Although in this preferred embodiment, one portion of the periphery of the additional wall 45 is extended in height, this does not adversely affect the performance of the transformer since the laminate can be installed normal to the projection so that the outboard legs of the core laminate lie on sides adjacent to the side of the projection 47. Moreover, the coil body can be predesigned so that the projection lies either at the top or at the bottom of the coil as the coil is assembled, wherever the projection will cause the least room problem. For example, in those designs where the base 19 is elevated above the attachment board, the projection could be on the underside.

The surpentine path caused by the leg 51 is clearly indicated in FIG. 6 where it is shown that the height A is chosen to be sufficiently deep in projecting into the space 60 between the walls 43 and 45 to provide the minimum creepage path.

According to present standards adopted in Europe by the International Commission on Rules for the Approval of Electrical Equipment (CEE), for voltages up to 380 volts, the minimum creepage path should be 10 mm. For voltages over 380, the minimum creepage path should be 12 mm. In such a system, by making the leg 51 have a projection into the space 60 equal to half the minimum distance, it can be seen that the total minimum distance will be achieved. On the other hand, the projection 47 should then project beyond the outermost coil winding by approximately half the minimum creepage distance as illustrated at A in FIG. 7.

The provision of the additional wall 45, and the additional wall 44, does not prevent the bobbin from being wound on standard winding equipment and maintains the overall general standard U.S. configuration.

As illustrated in FIG. 8, if desired, a third additional wall 62 may be provided adjacent the wall 42 and the cap 65 may then be provided with three inturned legs receivable respectively in the spaces between the walls 40 and 44, 43 and 45 and 42 and 62, thus enclosing both of the coil winding areas 63 and 64 on three sides.

FIG. 9 illustrates a similar construction where three winding areas 72, 73 and 74 are provided, two of which may be secondary windings and one of which may be a primary winding or two of which may be primary windings and one of which may be a secondary winding. In this construction the cap 75 is provided with four inturned legs totally enclosing the winding areas. Of course, if desired, only the central winding area 73 is necessarily enclosed with legs on each side thereof to provide the minimum creepage path requirements. In either case the additional walls adjacent the separating walls are extended at one side as at 75.

In those instances where it might be desired to enclose the coil winding area entirely, this can be accomplished by utilizing another U-shaped cross-section cap member having inturned side legs inserted into the gap area between the walls 40 and 44 and the walls 43 and 45 on the side of the coil body opposite the side of insertion of the cap member 50. In such an example, as shown in FIG. 10, the additional cap 80 can simply be a straight U-shaped cross section member with inturned legs and a bight with the legs extending the full length so as to overlap the legs 52 and 51 at the ends of the cap 80. Alternatively, as shown in FIG. 11, a second U-shaped cap, also U-shaped in cross-section, 81 may be utilized having side peripheral legs 82 in addition to the legs 51 and 52 which overlie the outside periphery of the main cap 50. In such an instance, the walls of the coil body can be provided with a variable thickness havng a lesser thickness in the area of overlap of the caps.

The coil body and the caps are preferably formed of a non-conductive material such as, for example, Valox, a trademark of the General Electric Corporation for a polycarbonate plastic. The caps and walls may be manufactured as thin as 30 mils. Therefore it can be seen that this construction does not significantly increase the dimensions of standard existing bobbins while at the same time providing the required minimum creepage path. In fact, it is believed that standard U.S. size transformers and coil bodies can be used with the modification of this invention to supply both the U.S. and the European market without requiring any changes in the coil winding machinery or in the size of the core laminates.

Further, as shown in FIGS. 14 and 15, a device constructed in accordance with the teachings of FIGS. 3 through 9 has the distinct advantage in providing a secured space for positioning a thermal protector fuse. Since, as shown in FIG. 14, a space 60 is provided between the walls 43 and 45, at the side of the coil body equipped with the projection 47 of the wall 45, which space is not otherwise filled by the cap structure, an ideal location is provided for insertion of a thermal fuse 100. As shown in FIG. 15, the thermal fuse 100 will then be positioned immediately between the windings of the coil winding areas 63 and 64 and therefore in close proximity to the coils. If desired, the walls 45 and 43 may be provided with recesses for receipt of the thermal protection fuse 100 as illustrated.

In FIGS. 1 through 11, I have shown standard axially spaced coil transformers. Radially spaced coil transformers are also known to the art and this invention is capable of being used to provide minimum creepage path distances for such radial winding transformers.

As shown in FIG. 12, radial winding transformers have a coil body 101 which is formed with a core tube 102 having out-turned end walls 103 and 104 providing a U-shaped cross-section to the coil body. A first winding 105 is wound in the bottom of the coil body. In standard practice, a tape or other separator may be provided radially outwardly of the first coil winding and the second coil winding is then wound around the first coil winding.

I have found that minimum creepage paths can be provided for by utilizing telescoping opposed U-shaped members having U-shaped cross-sections 107 and 108. Each of the members, as shown in FIGS. 12 and 13, has a bight 110, 111, which telescopes with the corresponding bight 110, 111 of the other member (shown in FIG. 13). Each of the members 107 and 108 is also provided with out-turned legs 117, 118. When telescoped together by insertion from opposite sides of the coil body, all four sides, in a rectangular cross-section coil, of the primary winding will be enclosed by a bight 110, 111 of at least one of the members 107, 108 and two sides will be enclosed by both bights. Additionally, the legs 117 and 118 will be overlapped, as shown in FIG. 12, on two sides (top and bottom sides of FIG. 13) and will be single on the remaining two sides, (left and right sides of FIG. 13). The second winding is then wound interior of the telescoped members 107 and 108 such that the second winding 116 lies radially outwardly of the bight sections.

It can therefore be seen that the minimum creepage path will, on all sides, be upwardly between the legs 103 and the opposed legs 117, 118 and the leg 104 and the opposed legs 117, 118. Thus, by dimensioning the legs 117, 118 by a dimension equal to the minimum creepage path, even if the secondary winding is wound to the other periphery of the legs, the minimum creepage path will be obtained. Of course, in the majority of radially wound transformers, the second winding 116 will not extend fully to the end of the legs 117, 118 and therefore those legs can be dimensioned such that the creepage distance includes the reverse distance back along the inside face of the legs to the outermost winding of the second winding 116.

It can therefore be seen that my invention provides an improved transformer wherein a minimum creepage path distance is established between the windings of the transformer by the interpositioning of an insulating cap member between the windings in such a manner that the creepage path between the windings, for at least a portion of the periphery of the transformer must undergo a reverse path around a portion of the interposed insulator member, the insulator member having a portion overlying the winding and a leg portion projecting normal to the core tube of the transformer, the minimum linkage path distance being measured around the leg path portion.

Although the teachings of my invention have herein been discussed with reference to specific theories and embodiments, it is to be understood that these are by way of illustration only and that others may wish to utilize my invention in different designs or applications.

I claim as my invention:

1. A coil body comprising: a rectangular hollow core having an outer surface and having first and second spaced axial walls projecting outwardly from the core surface around all four sides of the core substantially equidistantly from the outer surface, the projections being substantially to a first distance from the core outer surface, a first additional wall parallel to and closely spaced from the first wall projecting from the core outer surface to substantially the first distance around at least three sides of the core and substantially to at least the first distance on the fourth side of the core to create a first space between the first additional wall and the associated first wall, a second additional wall intermediate the first and second walls projecting from the core outer surface substantially equidistantly around the core to substantially the first distance to divide the area between the first and second walls and the primary and secondary winding areas, a third additional wall projecting from the outer surface parallel and closely spaced to the second additional wall to create a second space therebetween, the third additional wall projecting to substantially the first distance around three sides of the core and projecting to a second distance, greater than the first distance on the fourth side of the core, the projection on the fourth side being uninterrupted from the core's outer surface to the second distance, the second distance being greater than the first distance by an amount sufficient to establish a reverse path around the third additional wall on the fourth side at least equal to a minimum creepage between the primary and secondary winding areas, established for a transformer to be constructed from said coil body, said second distance being less than the amount necessary to establish a minimum creepage path therearound a single channel cap member having a top and two legs projecting from the top at right angles thereto with axially spaced inturned wall portions of the top and leg portions, the inturned wall portion sides being spaced from one another equal to the axial distance between the first and second spaces and having a thickness dimensioned to be received in the first and second spaces, said cap assembled onto the coil body with the inturned end wall portions received in the spaces on the three sides of the core where the third additional wall projects to substantially the first distance and with the top and two legs of the cap covering the area around the core for at least one of the primary and secondary winding areas on said three sides, the fourth side of both primary and secondary winding areas being open and not covered by a cap whereby the creepage path length on the fourth side is established solely by the projection of the third additional wall to the second distance and the coil body axis length between the primary and secondary winding areas, the top of the cap lying on the side of the coil body opposite the third wall projection to the second distance.

2. The coil body of claim 1, wherein said cap includes portions of said top and two legs covering both primary and secondary winding areas on the three sides, with the fourth side of both primary and secondary winding areas being open with the inturned wall portions received in the second space lying intermediate the axial ends of the top and two leg portions.

3. The coil body of claim 2, wherein said coil body includes a fourth additional wall parallel to and closely spaced from the second wall to create a third space therebetween, said cap having inturned wall portions extending to the third space.

* * * * *